United States Patent [19]

Dills

[11] 4,394,564

[45] Jul. 19, 1983

[54] SOLID PLATE HEATING UNIT

[75] Inventor: Raymond L. Dills, Louisville, Ky.

[73] Assignee: General Electric Company, Louisville, Ky.

[21] Appl. No.: 332,587

[22] Filed: Dec. 21, 1981

[51] Int. Cl.[3] ..... H05B 3/68

[52] U.S. Cl. ..... 219/449; 219/461; 219/462; 219/464; 219/466; 219/494; 219/510

[58] Field of Search ..... 219/441, 442, 446, 449, 219/450, 452, 455, 457, 461, 462, 464, 465, 466, 467, 468, 489, 494, 510, 530

[56] References Cited

U.S. PATENT DOCUMENTS

| | | | |
|---|---|---|---|
| 2,306,979 | 12/1942 | Potsdam | 219/449 |
| 2,813,963 | 11/1957 | Lennox | 219/449 |
| 3,018,356 | 1/1962 | Busch et al. | 219/489 |
| 3,069,526 | 12/1962 | Bremer et al. | 219/457 |
| 3,118,044 | 1/1964 | Holtkamp | 219/450 |
| 3,127,498 | 3/1964 | Gould et al. | 219/489 |
| 3,201,566 | 8/1965 | Schreyer | 219/441 |
| 3,569,672 | 3/1971 | Hurko | 219/461 |
| 3,622,754 | 11/1971 | Hurko | 219/462 |
| 3,624,352 | 11/1971 | Deaton et al. | 219/449 |
| 3,701,884 | 10/1972 | Finney | 219/449 |
| 3,710,076 | 1/1973 | Frazier | 219/449 |
| 3,845,273 | 10/1974 | Hurko | 219/462 |
| 3,883,719 | 5/1975 | Hurko | 219/464 |
| 3,885,128 | 5/1975 | Dills | 219/462 |
| 4,153,833 | 5/1979 | Fischer et al. | 219/449 |
| 4,237,368 | 12/1980 | Welch | 219/449 |

*Primary Examiner*—Volodymyr Y. Mayewsky
*Attorney, Agent, or Firm*—Frank P. Giacalone; Radford M. Reams

[57] ABSTRACT

A control system for a top plate surface heating unit having a softening temperature. The control system incorporates a temperature setting means for determining the operating temperature of the surface heating unit and means for automatically limiting the temperature of the surface heating unit to a temperature below the softening temperature of the top plate.

8 Claims, 5 Drawing Figures

SOLID PLATE HEATING UNIT

BACKGROUND OF THE INVENTION

Solid plate surface heating units have been developed prior to this time. However, generally, they have been constructed of heavy cast materials having relatively high thermal mass. Solid plate surface heating units having a relatively high thermal mass have a disadvantage in that they are relatively slow to heat up and slow to cool down as compared with the widely used sheathed heating elements. In overcoming this disadvantage, solid plate surface heating units have been constructed of light weight cast material having a very desirable high thermal conductivity at a relatively low thermal mass such as aluminum. Aluminum is desirable as a plate surface heating unit since head readily diffuses laterally through the plate surface. However, aluminum has a disadvantage in that it also has a relatively low melting point and cannot be used unprotected at temperatures above approximately 850° F.

Accordingly, when aluminum is employed as a plate surface heating unit, it must be protected from temperatures that exceed its melting point. Typical of prior art temperature limiting attempts is shown in U.S. Pat. No. 3,885,128 wherein a plate surface heating unit having a glass-ceramic surface and a layer of aluminum or copper on the underside is limited to an operating temperature below 1300° F., the critical temperature of the ceramic, by introducing a temperature limiting means to the surface unit such that the power to the heating element is cut off if the temperature rises to a predetermined temperature. In this instance, the temperature limiting application is to protect the glass-ceramic member. In other prior art teachings, plate surface units are provided with flash heat switches wherein full wattage is applied to the heating element until the plate surface reached a predetermined temperature at which time a lower wattage is applied to maintain the plate surface at the predetermined temperature.

The principal object of the present invention is to provide a low thermal mass, solid plate surface heating unit where the plate is made of a high thermal conductive material such as aluminum wherein heat readily diffuses laterally through the plate surface.

Another object of the present invention is to provide a control system for maintaining uniform temperature distribution and a rapid heat up including a temperature limiting feature.

Another object of the present invention is to provide a plate surface unit having an even lateral temperature distribution used with cooking utensils having irregular bottoms supported on the plate surface.

A further object of the present invention is to provide an aluminum heating plate having a control with a temperature limiting means that permits fast heat up rate without overheating the aluminum heating plate when used with cooking utensils having different diameters.

A still further object of the present invention is to provide an aluminum plate surface unit with an even temperature distribution that permits a metal sheathed heating element of high watts density to operate at relatively lower sheath temperature due to efficient thermal coupling between the heating element and the aluminum plate.

SUMMARY OF THE INVENTION

By the present invention, there is provided a control system for a plate surface heating unit having temperature setting means for selecting the cooking temperature of the surface heating unit and means for limting operation of the surface heating unit to below a maximum temperature at which the plate material (typically aluminum) will soften and melt. The surface heating unit includes a top plate of high thermal conductivity material such as aluminum that defines a utensil heating area. The utensil heating area is heated by a first metal sheathed electrical resistance heating element positioned in intimate contact with the underside of the aluminum top plate in the central portion of said heating area, and a second metal sheathed electrical resistance heating element in intimate contact with the underside of the aluminum top plate and being arranged externally of the first heating element.

The temperature of the utensil heating area is limited to the maximum temperature by a first temperature-limiting means that senses the temperature of the top plate at a plurality of locations adjacent the first heating element, and a second temperature limiting means that senses the temperature of the top plate at a plurality of locations adjacent the second heating element. The control includes circuit means connected between the temperature limiting means and the temperature setting means for deenergizing the first heating element when the temperature of the top plate in the central heating area adjacent the first temperature limiting means is above the maximum temperature and for deenergizing the second heating element when the temperature of the top plate in the external portion of the heating area adjacent the second temperature limiting means is above the maximum temperature.

The operating temperature of the heating area is maintained at the selected cooking temperature by a cycling means which controls energization of the first and second heaters at timed intervals independent of the first and second temperature limiting means.

DESCRIPTION OF THE PREFERRED EMBODIMENT

Figure 1:
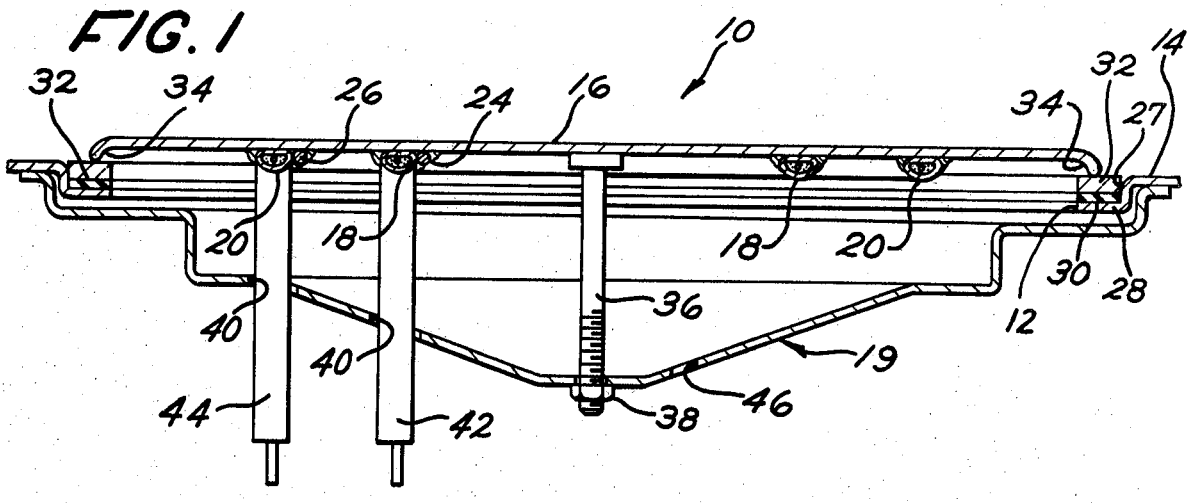
FIG. 1 is a cross-sectional elevational view of the solid plate surface heating unit embodying the present invention.
Figure 2:
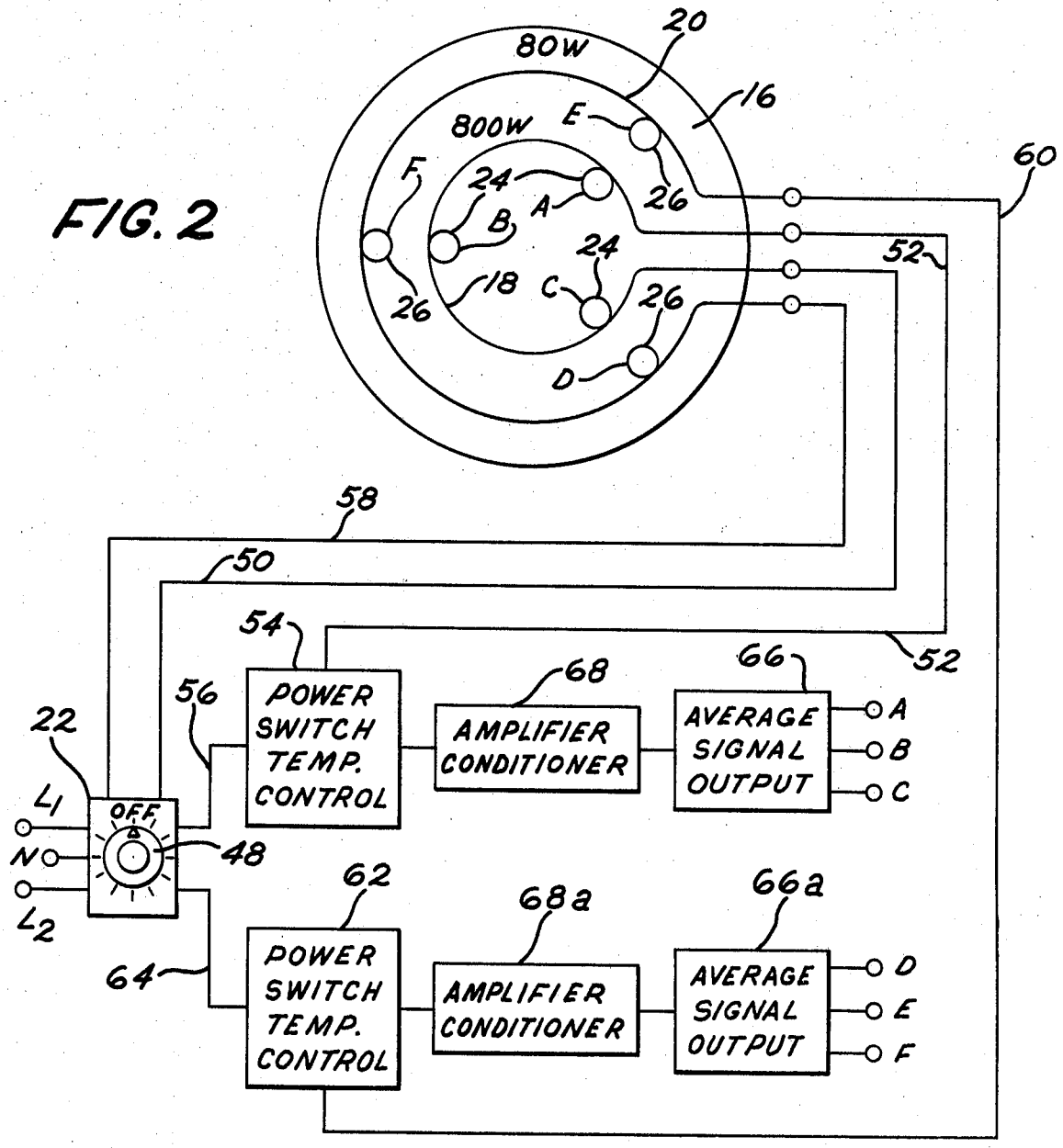
FIG. 2 is a schematic view showing the heating unit and the electrical control embodying the present invention.

Referring now to the drawings and more particularly to FIG. 1 thereof, there is shown a cross-sectional elevational view of a solid plate surface heating unit 10 which is particularly adapted for use as a range unit. The unit 10 is arranged in an opening 12 formed on the surface 14 of a range (not shown). The unit 10 includes an aluminum top plate 16 defining a cooking area and a pair of metal sheathed electrical resistance heating element 18 and 20, and a reflector pan 19. As mentioned above, the cooktop or surface 14 has formed therein the opening 12 in which the unit 10 is positioned. To this end, the opening 12 is formed to provide a recessed support flange 28 formed along its peripheral edges. Positioned on flange 28 is a resilient gasket 30 and a ceramic insulator 32. A ceramic material is selected for insulator 32 because it has a relatively low thermal conductivity and, accordingly, heat loss is minimized. The peripheral edge portion of the aluminum plate 16 is turned down to provide a contact point 34 which rests on the ceramic insulator 32. This arrangement between contact point 34 and ceramic insulator 32 presents a minimum amount of contact between the plate 16 and the cooktop 14 and, accordingly, a minimum amount of heat transfer therebetween. The reflector 19 as seen in FIG. 1 is larger than the opening 12 and is in contact with the underside of the cooktop 14 outwardly of opening 12. The reflector pan 19 is both assembled to the plate 16 and secured relative to the cooktop 14 by a single bolt 36 fixedly secured to the underside of the plate 16. The exact manner in which bolt 36 is secured to plate 16 is optional and may be accomplished by welding or brazing. The free end of bolt 36 is threaded, and a nut 38 employed to tighten and hold the reflector 19 against the underside of the cooktop 14 and contact point 34 of the plate 16 against the insulator 32 to sandwich the cooktop 14 between the plate 16 and reflector 19. The reflector pan 19 is provided with openings 40 for receiving the terminal ends 42 and 44 of the heating elements 18 and 20 respectively so that the appropriate electrical connections to the heating elements may be made conveniently externally of the surface unit. With reference to FIG. 2, it will be seen that the heating element 18 is substantially circular in configuration and is positioned in the central portion of the cooking area of plate 16. The heating element 20 is also substantially circular in configuration and is positioned exteriorly of the heating element 18 in the outer portion of the cooking area of plate 16. The plate 16 is formed of a relatively thin sheet material of high thermal conductivity such as aluminum. The aluminum effectively distributes the heat rapidly over the entire plate so as to obtain generally uniform temperature distribution across the entire surface of plate 16. The thickness of the aluminum sheet may vary depending of various factors such as the wattage output of the heaters, however, in carrying out the present embodiment of the invention, aluminum having a thickness of between 0.090 and 0.100 inches was used. While aluminum does have the desirable high thermal conductivity, it also has a relatively low melting point. In effect, as will be explained later during a normal cooking operation, the temperature of at least a portion of the heating area may exceed the temperature at which aluminum will soften or melt. Accordingly, a temperature limiting means must be provided to prevent the temperature of any portion of the plate 16 from exceeding the softening temperature of aluminum which is generally around 850° F. Further, the cooking area is maintained at a selected cooking temperature by the temperature setting element 22 which allows the user of the unit 10 to select an appropriate operating or cooking temperature. Element 22 may be of the well known infinite heat type wherein the selected temperature is maintained by cycling the power to the heating elements on and off at timed intervals. The higher the temperature selected through temperature selector 22, the longer the on time, or the time the heaters are energized ranging from full or 100% on time of heaters 18 and 20 at the highest temperature setting. In operation at the highest temperature setting of element 22 power is supplied to the heaters 100 percent of the time, which in fact means that to maintain the selected temperature there is essentially no cycling of power to the heaters. At the lowest temperature setting of element 22, power is supplied to the heater 5 percent of the time, which in fact means that to maintain the selected temperature there is a substantial amount of cycling with power being off 95 percent of the time. While this type of control is an acceptable method of maintaining a selected cooking temperature, it does not monitor or limit the temperature of the heating element or that of the top plate 16. In effect, the operating temperature of the heating elements at full on or high temperature setting is generally 1400° F. which will cause the aluminum top plate 16 to exceed the softening point thereof even though the selected cooking temperature is being maintained through element 22.

In employing a top plate such as aluminum that has a softening temperature somewhat below the operating temperature of the heating elements, means must be provided to limit the maximum temperature of the top plate. It should be noted that when a cooking utensil is employed that covers all or substantially all of the top plate, or more particularly the areas in contact with the heating elements, the temperature of the top plate because of the heat sink provided by the utensil will generally maintain the temperature of the top plate below the softening temperature. Accordingly, the temperature limiting means provided by the present invention is provided effective only during no-load conditions or when the cooking utensil used therein has a perfectly flat bottom and substantially all of the bottom surface of the utensil is in contact with all of the heating area. This is especially true when a cooking utensil is used that does not cover substantially all of the heating area or one having an irregular surface, or one with either a convex or concave bottom surface since, as mentioned above, the top plate will develop hot spots in the heating area not covered by or not in contact with the utensil. If the bottom wall of the cooking utensil is warped badly, there might only be a few contact points or small area of contact between the utensil and the top plate. The points or areas of contact would act as a heat sink area and would tend to create relatively cool spots in the top plate. The remainder of the bottom wall of the utensil not in contact with the plate does not provide a heat sink and, accordingly, the temperature of the plate in those areas would approach that of the heating element which, as noted above, is above the softening or melting point of aluminum. Further, that portion of the bottom wall of the utensil not in contact with the heating element will act as a reflector and redirect the heat received from the plate back toward the plate thereby creating hot spots where temperatures may exceed the softening melting point of the aluminum.

By the present invention, means are provided that permit full power of approximately 800 watts to be applied to each of the heating elements 18 and 20 while temperature limiting means effectively maintain the temperature in all portions of the cooking area of the top plate 16 below the softening point of aluminum whereby each of the heating elements may be deenergized independent of the other.

To this end, the temperature of the inner portion of the heating area is monitored by temperature sensing means 24 which are positioned in close proximity to the heating element 18. The temperature of the outer portion of the heating area is monitored by temperature sensing means 26 which are positioned in close proximity to heating element 20. The sensing elements 24 and 26 in the present instance may be of the thermistor type resistance sensor. The temperature sensing elements 24 and 26 are positioned to be in contact with both the associated heating element 18 and 20, respectively, and the adjacent area of the top plate 16. This arrangement causes the elements 24 and 26 to, in effect, sense the temperature of both the heating elements and the adjacent area of the plate 16. As best shown in FIG. 2, there are provided three equally spaced sensors 24 and 26 for each of the heaters 18 and 20 respectively. While, as will be explained later, it is desirable to sense or monitor the temperature of all portions of the heating area, the locations of the sensors relative to the heater and plate, and the exact number and location of temperature sensing elements may vary depending on many variables such as placement and shape of heaters relative to the size of the plate.

With reference to FIG. 2, it will be seen that power from supply line $L^1$ is supplied to the heater 18 through the temperature setting element 22 and through line 50. Power from heater 18, then flows through line 52 to a power switch temperature control switch 54, and then through line 56 and element 22 to power line $L^2$. Similarly, power from line $L^1$ is supplied to heater 20 through temperature setting element 22 and through line 58. From heater 20, power flows through line 60 to a power switch temperature control switch 62, then through line 64 and element 22 to power line $L^2$. The cooking temperature desired as mentioned above is selected by positioning a selector knob 48 of the temperature setting element 22 at a position from Hi to Low as indicated.

The temperature limiting control functions to control the maximum temperature at which the top plate 16 and heating elements 18 and 20 operate. In operation, any one or all of the temperature sensors 24 in the inner portion of the heating area designated A, B, and C in FIG. 2 transmit a signal when the temperature of the top plate and heater 18 in these area reaches the critical temperature of 850° F. at which aluminum will soften. This signal from the sensors 24 is transmitted to an average signal output element 66. The average signal output element employed in carrying out the present invention is of the type identified by the model number 2B54/2B55 manufactured by Analog Devices. The element 66 in turn transmits the average temperature of sensors A, B, and C to an amplifier conditioner 68. The amplifier conditioner 68 functions to provide an analog output. The signal from amplifier conditioner 68 is then fed to the power switch temperature control 54 which causes the heating element to be deenergized when the average temperature sensed by the sensors 24 is at or above the maximum temperature. The sensors 26 operate in the same manner as sensors 24, and the signal from sensors in the outer portion of the heating area designated D, E, and F similarly are fed through an average signal output element **66*a*, amplifier conditioner 68*a* and the power switch temperature control 62. The average signal output element employed is a temperature controller using state of the art circuitry. It should be noted that this cycling of the heaters relative to the maximum temperature control is independent of the operating temperature control of the heating element which, as noted above, is selected through the temperature setting element 22**.

Figure 3:
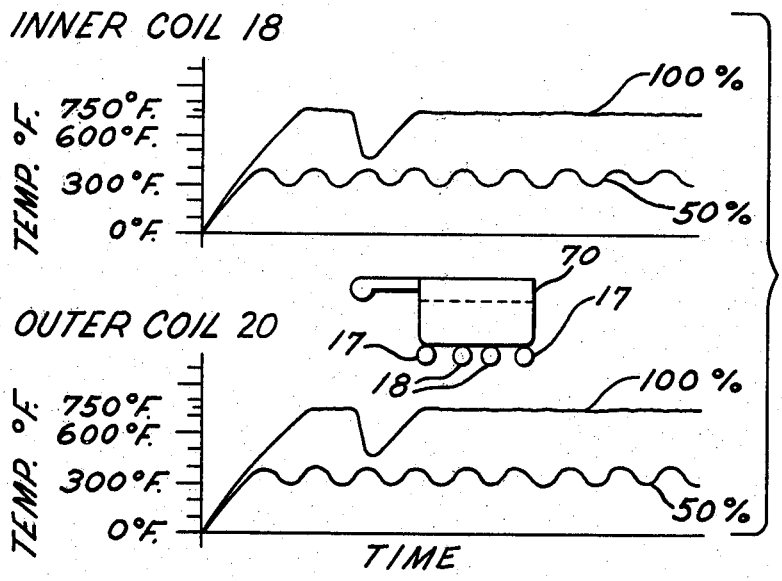
FIG. 3 is a diagramatic chart showing the operation of the heating element incorporated in the heating unit relative to the configuration of the bottom wall of the cooking utensil that contacts substantially all of the heating area.
Figure 4:
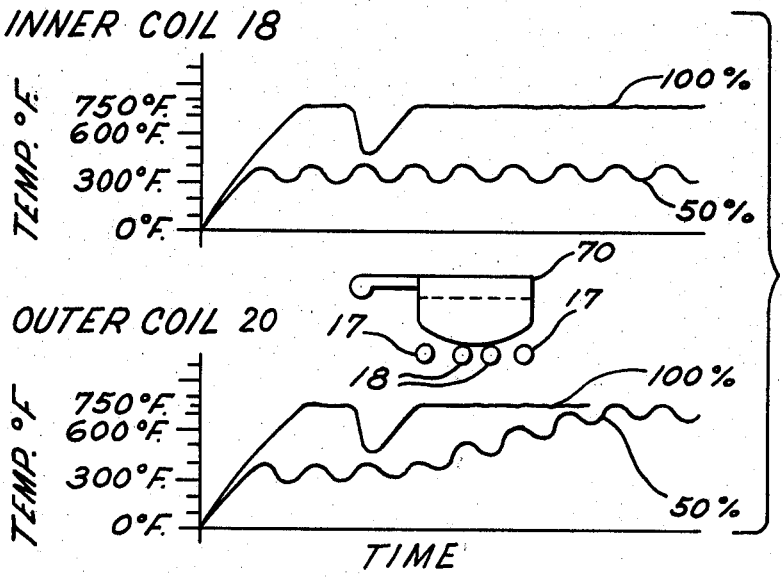
FIG. 4 is similar to FIG. 3 but showing the operation of the heating element relative to the configuration of the bottom wall of the cooking utensil that does not contact substantially all of the outer portion of the heating areas.
Figure 5:
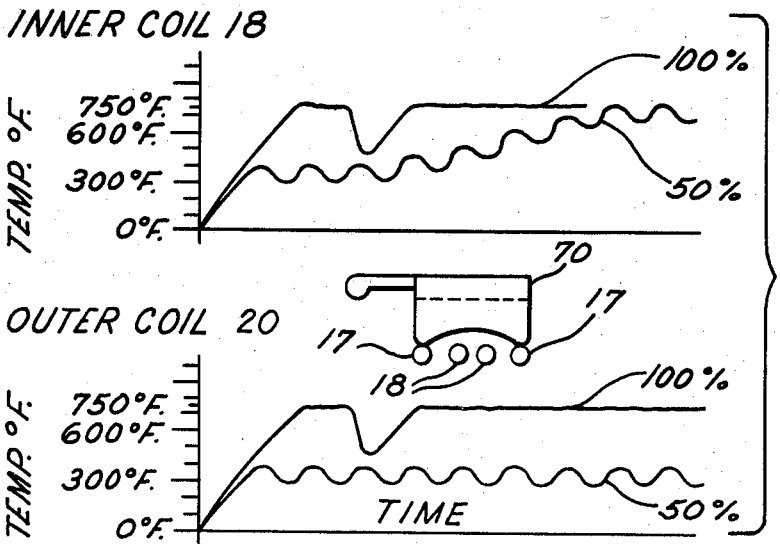
FIG. 5 is similar to FIG. 3 but showing the operation of the heating element relative to the configuration of the bottom wall of the cooking utensil that does not contact substantially all of the inner portion of the heating area.

Referring now to FIGS. 3–5, the operation of outer coil 20 and inner coil 18 are shown with the cooking temperature setting set at high with the heaters being on 100% of the time and set to a medium setting with the heaters being on 50% of the time. The operation of the coils are also shown relative to various shaped utensil bottom surfaces employed. With regard to FIG. 3, there is shown a utensil having a relatively flat bottom and of a size wherein contact is made with substantially all of the heating area. It will be seen that with the cooking setting at HI or 100% heater on time, both of the heaters 18 and 20 through the maximum temperature control system will be energized and will be maintained generally within a few degrees Fahrenheit of the maximum temperature of 750° F. With the cooking setting set at medium or 50%, both of the heaters under control of the temperature setting control 22 will cycle generally within the selected cooking range. However, with reference to FIG. 4, it will be seen that when a cooking utensil having a convex bottom is employed, contact between the utensil and plate is restricted to the area of the inner coil 18. In this instance at 100% on time, the present system will maintain both of the coils at or near the maximum temperature generally as in the case shown in FIG. 3 even though the utensil is not in contact with the outer coil portion of the heating area. The inner coil is cycling under control of the temperature setting control 22 while the outer coil is cycling under control of the sensors 24. In operation, with only the inner coil being covered by the utensil and the temperature setting control set at 50% on time, the inner coil will again cycle within the selected cooking range through the temperature setting control 22. However, the outer coil or portion of the heating area not in contact with the utensil will eventually reach the maximum temperature where it will come under control of the sensor 26 and will remain within the maximum temperature range as described above. With reference to FIG. 5, it will be seen that when a cooking utensil having a concave bottom is employed, contact between the utensil and plate is restricted to the area of the outer coil 20. In this instance, at 100% on time, the present system will maintain both of the coils 18 and 20 at or near the maximum temperature generally as in the case of FIGS. 3 and 4 even though the utensil is not in contact with the inner coil portion of the heating area. At 50% on time, the outer coil will again cycle within the selected cooking range through the temperature setting control 22. However, the inner coil or portion of the heating area not in contact with the utensil will eventually reach the maximum temperature where it will come under the control of the sensor 24 and will remain within the maximum temperature range as described above.

In summary, by the present invention, a control system is provided wherein the top plate 16 of the cooking unit is protected from excessive temperatures that would cause damage to the aluminum plate surface regardless of the contact made between the utensil and heating area while the unit is operating within the cooking temperature selected by the temperature setting element 22.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A plate surface heating unit having a top plate defining a heating area, said top plate having a softening temperature, temperature setting means for determining the operating temperature of said top plate including a control system for maintaining said heating area substantially at the selected cooking temperature while maintaining the temperature of said heating area below the softening temperature of said top plate comprising:

a metal sheathed electrical resistance heating element in intimate contact with the underside of said top plate, said element having a heating capacity capable of elevating the temperature of said top plate above its softening temperature;

a temperature-sensing means arranged for sensing the temperature of said top plate at a plurality of selected locations in said heating area;

cycling means in said temperature setting means operable to control energization of said heating element to maintain the temperature of said top plate at said operating temperature;

a control means in circuit connection between said temperature sensing means and said temperature setting means for deenergizing said heating element independent of said cycling means when the temperature sensed by said temperature sensing means of said top plate and said heating element at said selected locations of said heating area reaches a selected temperature below the softening temperature of said top plate.

2. The plate surface heating unit recited in claim 1 wherein said temperature sensing means are positioned to sense the temperature of said heating element and the adjacent area of said top plate.

3. The plate surface heating unit recited in claim 2 wherein said control means further includes means for averaging the temperature sensed by said temperature sensing means at said plurality of selected locations for producing an average temperature signal.

4. The plate surface heating unit recited in claim 3 wherein said control means further includes power switch means connected to be responsive to said average temperature signal for controlling operation of said heating elements independent of said temperature setting means when the temperature of said top plate approaches said softening temperatures.

5. A plate surface heating unit having an aluminum top plate defining a heating area, temperature setting means for determining the operating temperature of said top plate including a control system for maintaining said heating area substantially at the selected cooking temperature while maintaining the temperature of said heating area below a selected maximum temperature comprising:

a first metal sheathed electrical resistance heating element in intimate contact with the underside of said top plate in the central portion of said heating area;

a second metal sheather electrical resistance heating element in intimate contact with the underside of said top plate being arranged externally of said first heating element in the outer portion of said heating area;

a first temperature-sensing means arranged for sensing the temperature of said top plate and said first heating element at a plurality of selected locations in the central portion of said heating area;

a second temperature sensing means arranged for sensing the temperature of said top plate and said first heating element at a plurality of selected locations in the outer portion of said heating area;

a first control means in circuit connection between said first temperature sensing means and said temperature setting means for deenergizing said first heating element when the temperature sensed by said first temperature sensing means of said top plate and said first heating element at said selected locations in the central portion of said heating area reaches said maximum selected temperature;

a second control means in circuit connection between said second temperature sensing means and said temperature setting means for deenergizing said second heating element when the temperature sensed by said second temperature sensing means of said top plate and said second heating element at said selected locations in the outer portion of said heating area reaches said maximum selected temperature; and cycling means in said temperature setting means operable to control energization of said first and second heating elements to maintain the temperature of said top plate at said operating temperature independent of said first and second control means.

6. The plate surface heating unit recited in claim 5 wherein said temperature sensing means associated with said first and second heating elements are positioned to sense the temperature of said heating element and the adjacent area of said top plate.

7. The plate surface heating unit recited in claim 6 wherein said first and second control means further includes means for averaging the temperature sensed by said first and second temperature sensing means for producing an average temperature signal.

8. The plate surface heating unit recided in claim 7 wherein said first and second control means further includes power switch means responsive to said average temperature signal for controling energization of said first and second heating elements.

* * * * *